US007399361B2

(12) United States Patent
de Leeuw et al.

(10) Patent No.: US 7,399,361 B2
(45) Date of Patent: Jul. 15, 2008

(54) APPARATUS FOR APPLYING FLUID TO A SUBSTRATE

(75) Inventors: Victor de Leeuw, Hilvanrenbeek (NL); Wendelinus Cornelis van der Heijden, Drunen (NL)

(73) Assignee: Nordson Corporation, Westlake, OH (US)

( * ) Notice: Subject to any disclaimer, the term of this patent is extended or adjusted under 35 U.S.C. 154(b) by 431 days.

(21) Appl. No.: 11/115,059

(22) Filed: Apr. 26, 2005

(65) Prior Publication Data

US 2005/0274317 A1 Dec. 15, 2005

(30) Foreign Application Priority Data

Apr. 30, 2004 (DE) ..... 20 2004 007 024 U

(51) Int. Cl.
*B05C 5/00* (2006.01)
*B05C 3/02* (2006.01)
*B05B 15/06* (2006.01)

(52) U.S. Cl. ..... 118/300; 118/410; 239/390; 239/600

(58) Field of Classification Search ..... 118/300, 118/410; 239/296, 298, 594, 552, 556, 583, 239/600, 391–397, 390
See application file for complete search history.

(56) References Cited

U.S. PATENT DOCUMENTS

| | | | | |
|---|---|---|---|---|
| 4,613,078 | A | 9/1986 | Marshall | 239/390 |
| 4,969,602 | A | 11/1990 | Scholl | 239/298 |
| 4,983,109 | A | 1/1991 | Miller et al. | 425/7 |
| 5,169,071 | A | 12/1992 | Boger et al. | 239/296 |
| 6,056,155 | A | 5/2000 | Byerly et al. | 222/1 |
| 6,619,566 | B2 | 9/2003 | Gressett, Jr. et al. | 239/296 |
| 6,676,038 | B2 | 1/2004 | Gressett, Jr. et al. | 239/296 |
| 2002/0134858 | A1 | 9/2002 | Gressett, Jr. et al. | |
| 2002/0134859 | A1 | 9/2002 | Gressett, Jr. et al. | |

*Primary Examiner*—Yewebdar T Tadesse
(74) *Attorney, Agent, or Firm*—Wood, Herron & Evans, LLP

(57) ABSTRACT

An apparatus for applying fluid from a fluid source to a substrate. The apparatus comprises a housing configured to receive the fluid from the fluid source, a nozzle arrangement in fluid communication with the housing, and a lever pivotally mounted to the housing for releasably securing the nozzle arrangement thereto.

26 Claims, 8 Drawing Sheets

APPARATUS FOR APPLYING FLUID TO A SUBSTRATE

TECHNICAL FIELD

The invention concerns an apparatus for applying fluid comprising housing and an associated applicator nozzle arrangement releasably secured thereto.

BACKGROUND

Apparatuses which include applicator heads, applicator nozzle arrangements, adaptor plates and/or mounting plates are used in various sectors of industry in order to continuously or intermittently apply different materials which are capable of flow. For example, adhesives, lacquers, and coating materials are applied to hygiene articles, wood products, machine parts, and bodywork parts of vehicles or the like, in bead form, line form, point form or over an area.

For that purpose the applicator nozzle arrangements and applicator heads are connected to a fluid source, for example, an adhesive container, from which the fluid may be conveyed by a pump through a feed passage to the applicator nozzle arrangement. The flow of fluid can be interrupted or enabled, such as by a valve arrangement which is connected into the feed passage. When the valve is in the open condition the fluid then flows through a discharge passage in the applicator nozzle arrangement. The passage communicates with a discharge opening for delivery of the fluid, from which the fluid then issues under pressure and then passes on to the substrate which is movable, for example, by a conveyor device relative to the discharge opening and thus relative to the applicator nozzle arrangement. When the fluid is being applied the applicator nozzle arrangement can be in contact with the substrate (contact type). In other embodiments, the applicator nozzle arrangement maintains a spacing between itself and the substrate (non-contact type).

Such applicator heads and applicator nozzle arrangements are known, for example, from PCT/EP00/04137 to the present applicants.

In order to maintain, repair or replace the applicator head and/or the applicator nozzle arrangement in the state of the art, it is necessary to release the large number of fixing screws which connect the applicator nozzle arrangement to the applicator head, such screws generally being difficult to access by virtue of the geometry of the machine. That procedure needs tools, takes up time and from time to time requires skill on the part of the fitter. In addition, after the mounting operation, it is necessary to check for correct positioning of the applicator nozzle arrangement which has possibly altered during the mounting procedure, and that is complicated and expensive.

SUMMARY OF THE INVENTION

The present invention provides an apparatus, or applicator head, for applying fluid from a fluid source to a substrate. The apparatus comprises a housing configured to receive fluid from the fluid source, a nozzle arrangement in fluid communication with the housing, and a lever pivotally mounted to the housing for releasably securing the nozzle arrangement thereto. The nozzle arrangement includes a discharge passage applying the fluid to the substrate.

An advantage of the invention is that no tool is necessary for replacing the applicator nozzle arrangement. This permits the applicator nozzle arrangement to be quickly and inexpensively changed. A further advantage is that, in the event of a change of the applicator nozzle arrangement, it can be very easily and very precisely positioned. Because precise positioning is an important prerequisite for trouble-free operation of adhesive applicator apparatuses, the invention also reduces the error probability of such installations and thus enhances the availability thereof. Those advantages are achieved by the lever according to the invention.

By virtue of the fact that it is possible to forego the use of tools for replacing the applicator nozzle arrangement, there is also no longer any need, in terms of the design structure, to take account of the fact that sufficient space is kept free for the use of a tool. In this respect, the specified advantages can be achieved by means of a simple and thus inexpensive structure. In addition, existing applicator apparatuses can be easily retrofitted therewith.

In a preferred embodiment of the invention the lever is mounted on the housing, or main body. In an installation for applying fluids to a movable substrate, a large number of various applicator nozzle arrangements per applicator head are usually kept on hand. The provision of the lever on the main body minimizes the number of levers required overall.

It is preferable for the lever to be adapted to exert a force on the applicator nozzle arrangement, in which respect the force acts substantially parallel to the contact surface between the applicator nozzle arrangement and the main body. The fluid leaving the applicator head is applied to a generally movable substrate which moves along the applicator surface of the applicator nozzle arrangement. In order to prevent the substrate from being adversely affected by the applicator nozzle arrangement, it is advantageous if the latter has no openings whatsoever or other surface irregularities. The fact that the force exerted on the applicator nozzle arrangement by the lever acts parallel to the contact surface between the applicator nozzle arrangement and the main body avoids the lever having to engage into the surface which is proximate the substrate.

It is preferred that a torque can be applied to the lever by an adjusting screw. Friction occurs at the areas of contact between the adjusting screw and the applicator head, and the adjusting screw and the lever respectively. That friction prevents the adjusting screw coming loose during operation so that the torque applied to the lever does not change during operation.

It is particularly preferable for the adjusting screw to be arranged at the end of the lever, which is proximate the main body. This arrangement provides that the adjusting screw is at a great spacing from the pivot point of the lever so that a good lever ratio is achieved. This arrangement also means that the adjusting screw is disposed at a relatively large spacing from the possibly hot applicator nozzle arrangement. Alternatively the adjusting screw can be disposed on the same side as the applicator nozzle arrangement, as viewed from the mounting of the lever.

In a preferred embodiment of the invention, the applicator nozzle arrangement and the lever engage each other in a positively locking relationship. This affords a particularly robust connection between the applicator nozzle arrangement and the applicator head. Even if the clamping force exerted by the lever slackens, the positively locking engagement ensures that the applicator nozzle arrangement cannot come loose from the applicator head.

In a preferred embodiment of the invention, at its end in contact with the applicator nozzle arrangement, the lever has a portion with a convex and arcuate contour. A convex and arcuate contour provides an extended contact region between the lever and the applicator nozzle arrangement. Such a contour also has a positive effect on the levels of positioning accuracy which can be achieved.

It is preferred that the main body has a support section against which the applicator nozzle arrangement can be pressed by the lever. The support section is configured to serve as an abutment such that it results in an increase in the level of positioning accuracy.

It is particularly preferred in that respect for the concave structure to have a preferably flat guide surface which extends in such a way that the applicator nozzle arrangement is pressed against the main body by the action of the lever. That affords a secure clamping connection between the applicator nozzle arrangement and the main body.

In a preferred embodiment, the applicator nozzle arrangement is guided linearly between the support section and the one end of the lever. In such an arrangement only the lever has to be released in order to change the applicator nozzle arrangement. The applicator nozzle arrangement can then be released from the applicator head by a translatory movement. The linear guidance also enhances the degree of positioning accuracy of the applicator nozzle arrangement relative to the applicator head.

A preferred applicator nozzle arrangement is one which includes a concave recess extending along a narrow side and a convex projection extending along the narrow side which is in opposite relationship to said narrow side. Such an arrangement provides that the applicator nozzle arrangement can only be connected to the applicator head in one way, namely the correct way, and therefore excludes mounting errors.

A particularly preferred applicator nozzle arrangement is one in which the convex projection is adapted for co-operating with a concave structure of the main body of an applicator head as described above. The co-operation of the convex projection with the concave structure affords a large contact surface area for the applicator nozzle arrangement on the applicator head so that this ensures a high level of positioning accuracy and a secure connection between the two.

In a preferred embodiment, the applicator nozzle arrangement has an arresting member which limits a movement in a direction parallel to the contact surface of the main body and the applicator nozzle arrangement. The arresting member is formed in particular by a hollow pin in which a ball is subjected to a spring force such that a fraction of the ball projects beyond an end face of the hollow pin. In that respect, the term "movement" is only used to denote a movement of the applicator nozzle arrangement, such movement being guided by the main body, as occurs upon mounting of the applicator nozzle arrangement.

The arresting member permits precise positioning and at the same time rapid mounting of the applicator nozzle arrangement on the applicator head. If the above-mentioned hollow pin is used and if the applicator nozzle arrangement is disposed in the correct position relative to the applicator head, then the spring-loaded ball in the hollow pin is urged further beyond the end of the hollow pin by the spring force, by an amount which is small relative to its diameter. In that situation the ball engages into a recess provided on the applicator nozzle arrangement so that the applicator nozzle arrangement and the applicator head are secured relative to each other.

A preferred adaptor plate according to the invention is adapted for mounting to a main body of an above-described applicator head. The adaptor plate includes a concave recess extending along a narrow side and a convex projection extending along the narrow side which is in opposite relationship to said narrow side. Moreover, in a preferred embodiment of the adaptor plate the convex projection is adapted for co-operating with a concave structure of the main body of an applicator head. It is also desirable if the adaptor plate has an abutment, in particular a pin, which limits a movement in a direction parallel to the contact surface of the main body and the applicator nozzle arrangement.

A particularly preferred adaptor plate is one which includes a recess for accommodating an elastic sealing element. Upon mounting of the applicator nozzle arrangement to the applicator head the elastic sealing arrangement is elastically deformed and thus prevents leakage flows of the fluid in the situation where the two components are not perfectly positioned relative to each other.

A preferred mounting plate is one in which the lever is mounted to the main body. That permits rapid retro-fitment of applicator systems which hitherto operate with another clamping system.

BRIEF DESCRIPTION OF THE DRAWINGS

An embodiment of the present invention is described hereinafter with reference to the drawings in which.

DETAILED DESCRIPTION

Figure 1:
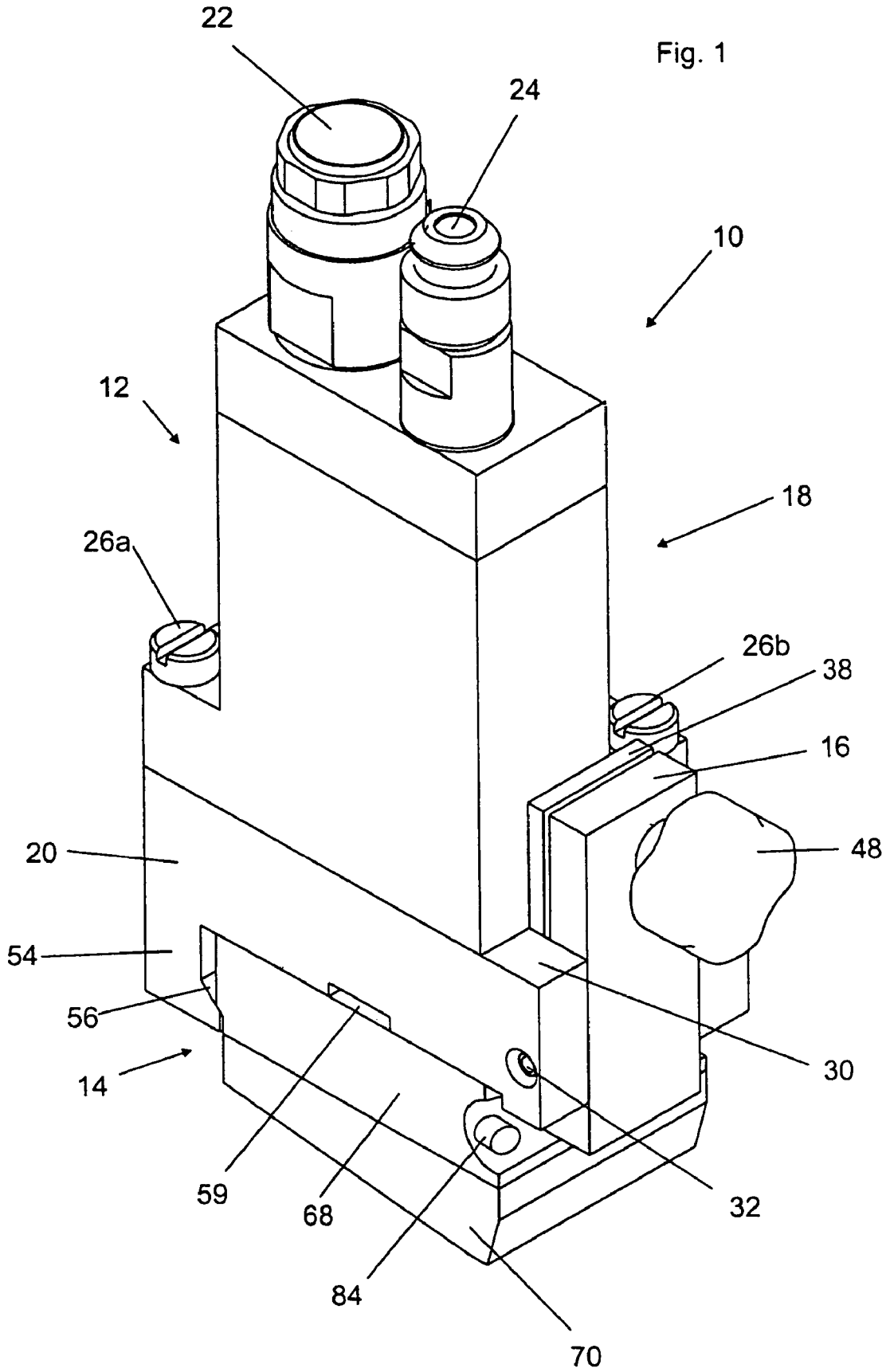
FIG. 1 shows a perspective view of an applicator head, or apparatus, with a correspondingly associated, mounted applicator nozzle arrangement.

FIG. 1 shows an applicator head 10, or apparatus 10, which has a main body 12, or housing 12, an associated applicator nozzle arrangement 14 and a lever 16. The main body 12 includes a dosing dispenser 18 and a mounting plate 20.

The dosing dispenser 18 is of substantially cuboidal configuration and at one of its narrow sides has an electrical connection 22 for connection to a voltage source and a connection 24 for the feed of fluid. A solenoid (not shown here) which enables or interrupts the delivery of fluid from the applicator head 10 is supplied with power by way of the connection 22. The mounting plate 20 is mounted to the side opposite to the connections 22, 24, by two screws 26*a*, 26*b*. In that case the screw 26*a* engages into a screwthreaded hole 28*a* (see FIG. 6) and the screw 26*b* correspondingly engages into a screwthreaded hole 28*b* in the mounting plate 20. The dosing dispenser 18 and the mounting plate 20 are flush with each other at three sides.

Figure 5:
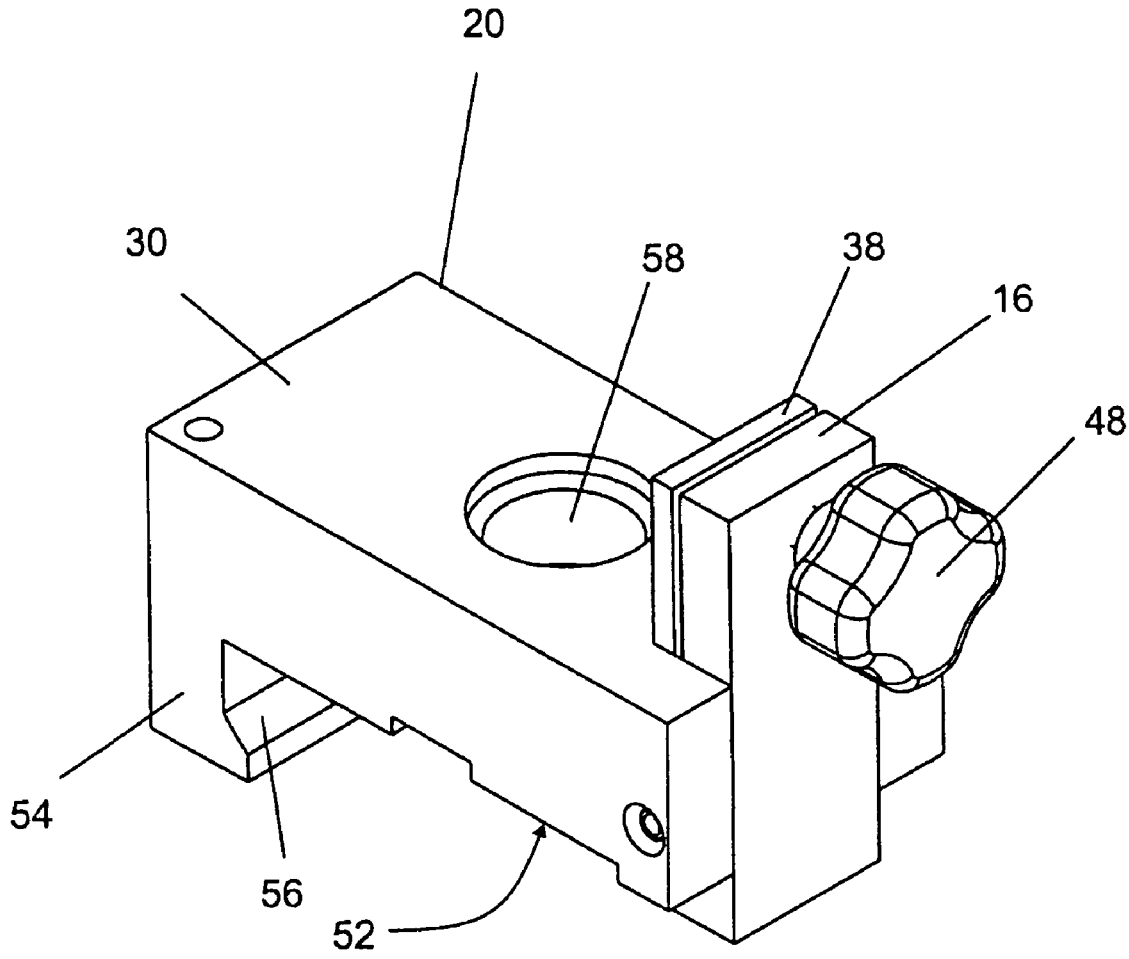
FIG. 5 shows a mounting plate.
Figure 6:
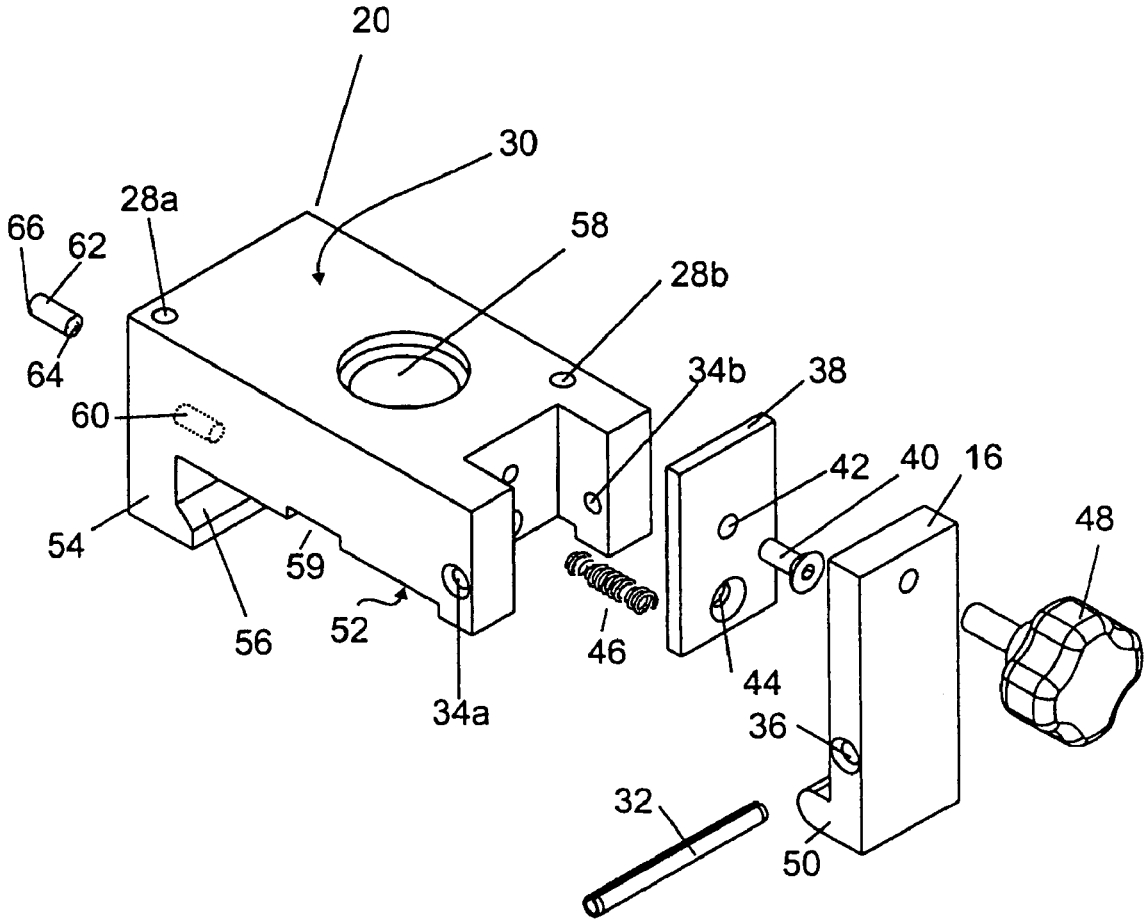
FIG. 6 shows an exploded view of the mounting plate of FIG. 5.

The mounting plate 20 is positioned with a contact surface 30 against the dosing dispenser 18 (see also FIGS. 5 and 6). The lever 16 is mounted pivotably by a pin 32 at that narrow side of the mounting plate 20, which does not terminate with the narrow side of the dosing dispenser 18. As FIG. 6 shows in an exploded view, the pin 32 is accommodated in two mounting bores 34*a*, 34*b* in the mounting plate 20 and extends through a mounting bore 36 in the lever 16.

Disposed adjacent to the lever 16 on the mounting plate 20 is a rectangular contact plate 38. An upper part of the contact plate 38 projects beyond the contact surface 30 of the mounting plate 20, while a lower part is positioned with its rear side against the body of the mounting plate 20. The contact plate 38 is screwed to the mounting plate 20 by a hexagon socket head screw 40 which extends through a hole 42. A through bore 44 extends in the contact plate 38 in the lower end thereof, and a spring 46 extends through the through bore 44. The spring 46 is positioned with one end against the body of the mounting plate 20 and with its other end against the lever 16, and braces the two components against each other under pressure.

At its end opposite the pin 32 and the contact point of the spring 46, the lever 16 carries an adjusting screw 48 disposed in a screwthreaded hole. The screw, when rotated in the clockwise direction, tightens the lever 16 against the contact plate 38 so that the spring 46 is compressed. At the same end as the pin 32 and the support point of the spring 46, the lever 16 terminates in a convex contour 50 which is proximate the mounting plate 20 and which in the present case is in the form of a circular arc.

The mounting plate 20 has a nozzle contact surface 52 which extends parallel to the contact surface 30 and which is delimited by a projection 54 at its side opposite the lever 16. The projection 54 is of such a configuration that the mounting plate 20 is substantially in the form of an L provided with serifs, the back of which is the contact surface 30. In this arrangement the projection 54, at its end remote from the contact surface 30, has a flat guide surface 56 which faces towards the contact surface 52. Rotation of the adjusting screw 48 in the clockwise direction moves the end of the lever 16 with the convex contour 50 towards the projection 54.

Between the contact surface 30 and the contact surface 52 a through bore 58 which is drilled out passes completely through the mounting plate 20. An O-ring (not shown) is fitted into a groove in the through bore 58. That O-ring serves to prevent leakage flows when the mounting plate 20 is mounted to the dosing dispenser 18.

Adjoining the side surfaces which are adjacent to the projection 54 and the lever 16 is a recess 59 which blends into the contact surface 52. The internal width of the recess 59 is greater than the outside diameter of the O-ring (not shown) which is fitted into the groove in the through bore 58. That prevents the O-ring from being sheared off when the mounting plate 20 is mounted to the applicator nozzle arrangement.

Figure 3:
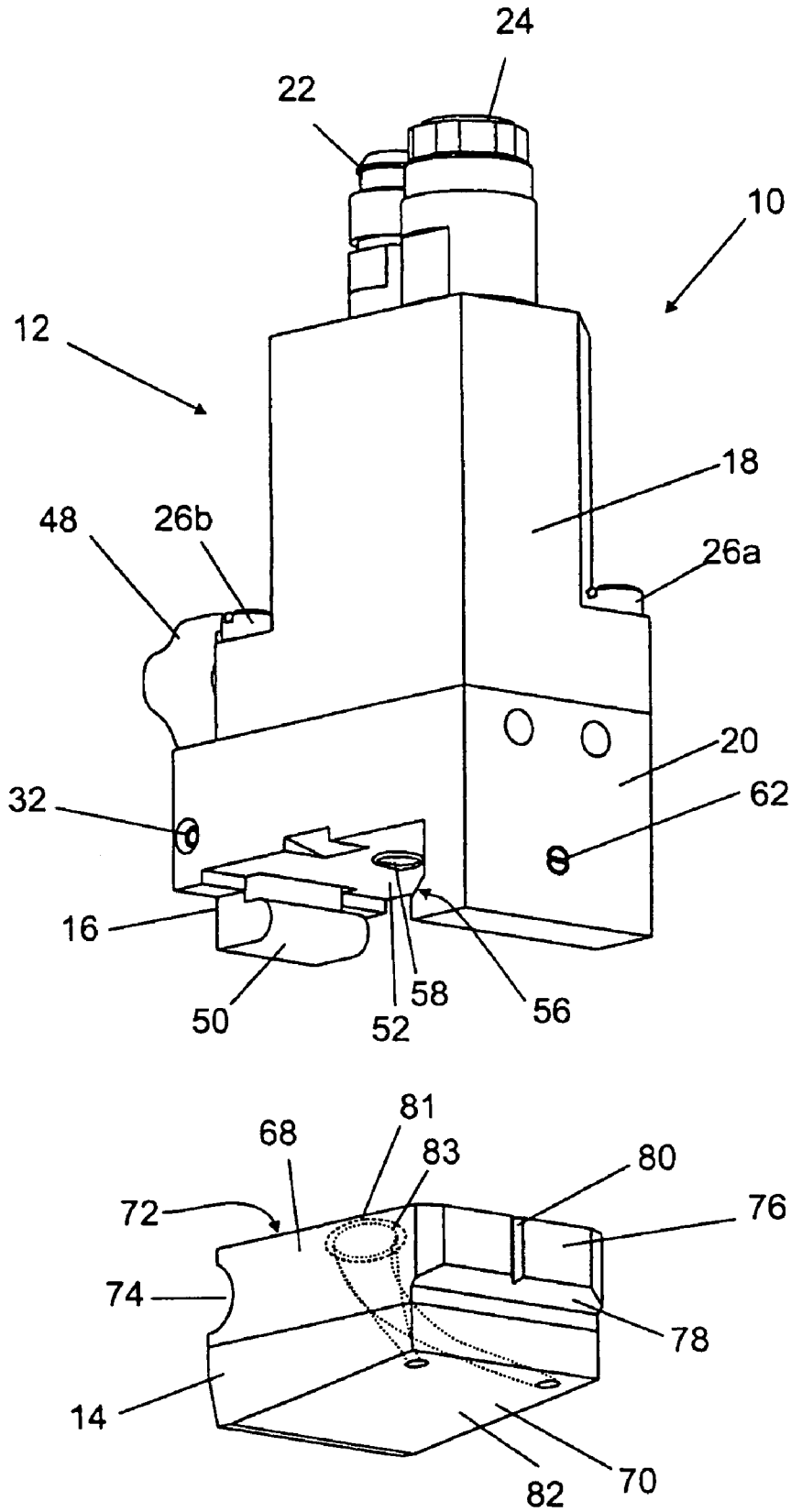
FIG. 3 shows a perspective view of the applicator head and the applicator nozzle arrangement of FIGS. 1 and 2, in the separated condition.
Figure 4:
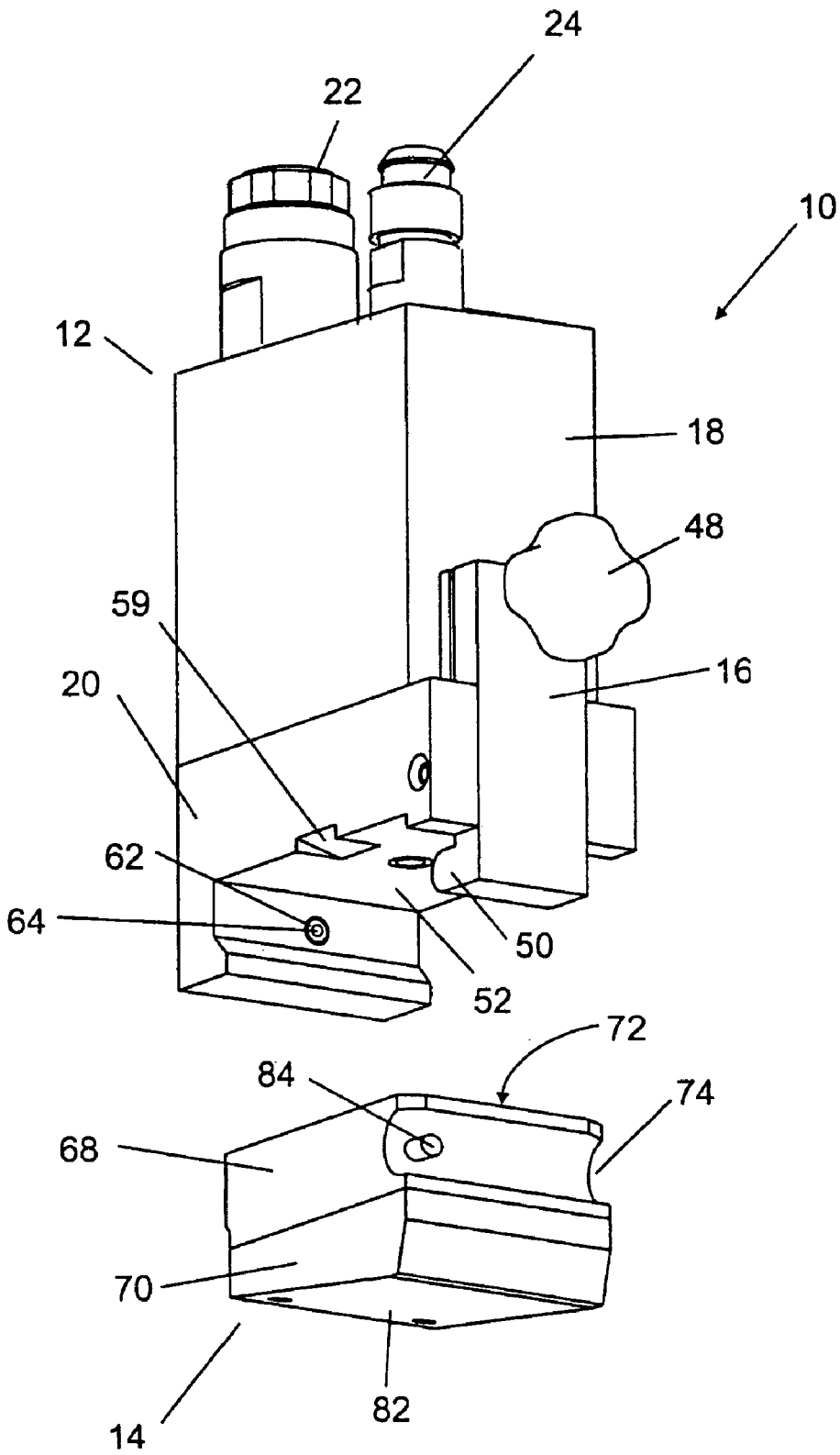
FIG. 4 shows a further perspective view of the components as shown in FIG. 3.

Extending centrally through the projection 54 is a screwthreaded through bore 60 into which is screwed a centering pin 62 with a male screwthread thereon (FIG. 6, see FIGS. 3 and 4). On its side which is closer to the lever 16 in the position of installation, the centering pin 62 has a raised portion 64 while on the side in opposite relationship to that raised portion it has a slot 66. In the installed position, the centering pin 62 terminates flush with the projection 54 in such a way that only the raised portion 64 projects on the side of the centering pin that faces towards the lever 16 (see FIG. 4).

Figure 2:
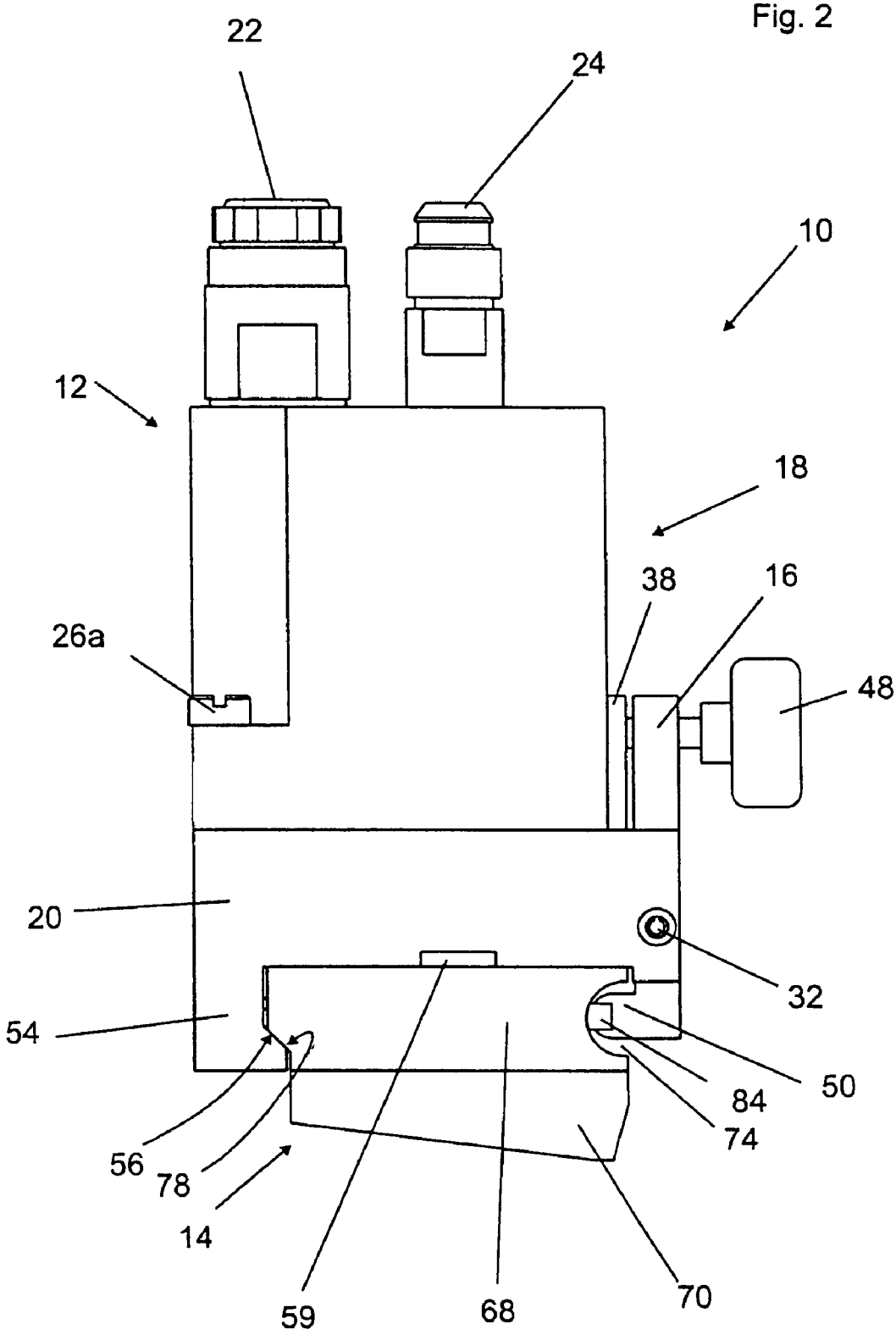
FIG. 2 shows a side view of the applicator head and the associated applicator nozzle arrangement of FIG. 1.

As FIG. 2 shows, the flat guide surface 56 of the projection 54 forms an undercut configuration; together with the end of the lever 16, which has the convex contour 50, a space is thus formed jointly with the contact surface 52 for receiving the applicator nozzle arrangement 14.

The applicator nozzle arrangement 14 includes an adaptor plate 68 and a nozzle plate 70 which are connected together fixedly but releasably, for example by four screws (FIG. 3). At an inlet side, or its side which in the position of installation is proximate the contact surface 52 of the mounting plate 20, the applicator nozzle arrangement 14 has a contact surface 72. In a first sidewall, or narrow side adjacent to the contact surface 72, there is an arcuate recess 74 which extends along that narrow side and which is larger than the convex contour 50 of the lever 16 (see FIG. 2). Provided on the opposite narrow side, or second sidewall, is a projection 76 in the form of a truncated pyramid, whose one narrow side terminates flush with the contact surface 72. Disposed in opposite relationship to that surface is a sliding surface 78 which is inclined with respect to the contact surface 72 by the same angle as the guide surface 56 is inclined with respect to the contact surface 52.

Extending perpendicularly to the contact surface 72 in the projection 76 is a slot 80 which is of a depth that is greater than the amount by which the raised portion 64 of the centering pin 62 (see FIG. 6) projects in the position of installation beyond the corresponding boundary surface of the projection 54.

Extending into the contact surface 72 is a bore 81 which is not visible in FIG. 3 and which is therefore shown in broken line. It extends from the contact surface 72 through the applicator nozzle arrangement 14 and terminates in an underneath surface 82, or outlet surface 82, which is in opposite relationship to the contact surface 72. The underneath surface 82 is that surface of the applicator nozzle arrangement 14, which comes into contact with a movable substrate when fluid is being applied to the substrate. Positioned in the bore 81 is an O-ring 83, which is also not visible in FIG. 3 and is therefore shown in broken line, and which projects in part beyond the contact surface 72.

For the purposes of mounting the applicator nozzle arrangement 14 to the main body 12, the applicator nozzle arrangement 14 is positioned beside the main body 12 in such a way that its contact surface 72 extends substantially parallel to the contact surface 30 of the main body 12. The applicator nozzle arrangement 14 is then moved towards the main body 12 so that the sliding surface 78 comes into contact with the guide surface 56 and the recess 74 embraces the convex contour 50 of the lever 16 in a positively locking relationship. In that situation the applicator nozzle arrangement 14 is linearly guided by the projection 54 and by the convex contour 50 of the lever 16.

Provided on the applicator nozzle arrangement is an arresting pin 84 (see FIGS. 1 and 2) which stops the movement of the applicator nozzle arrangement 14 by abutting against the lever 16 when the applicator nozzle arrangement is in the correct position. In that position, to secure the assembly, the centering pin 62 is screwed in, engaging into the slot 80 and thus securely fixing the applicator nozzle arrangement 14.

Figure 7:
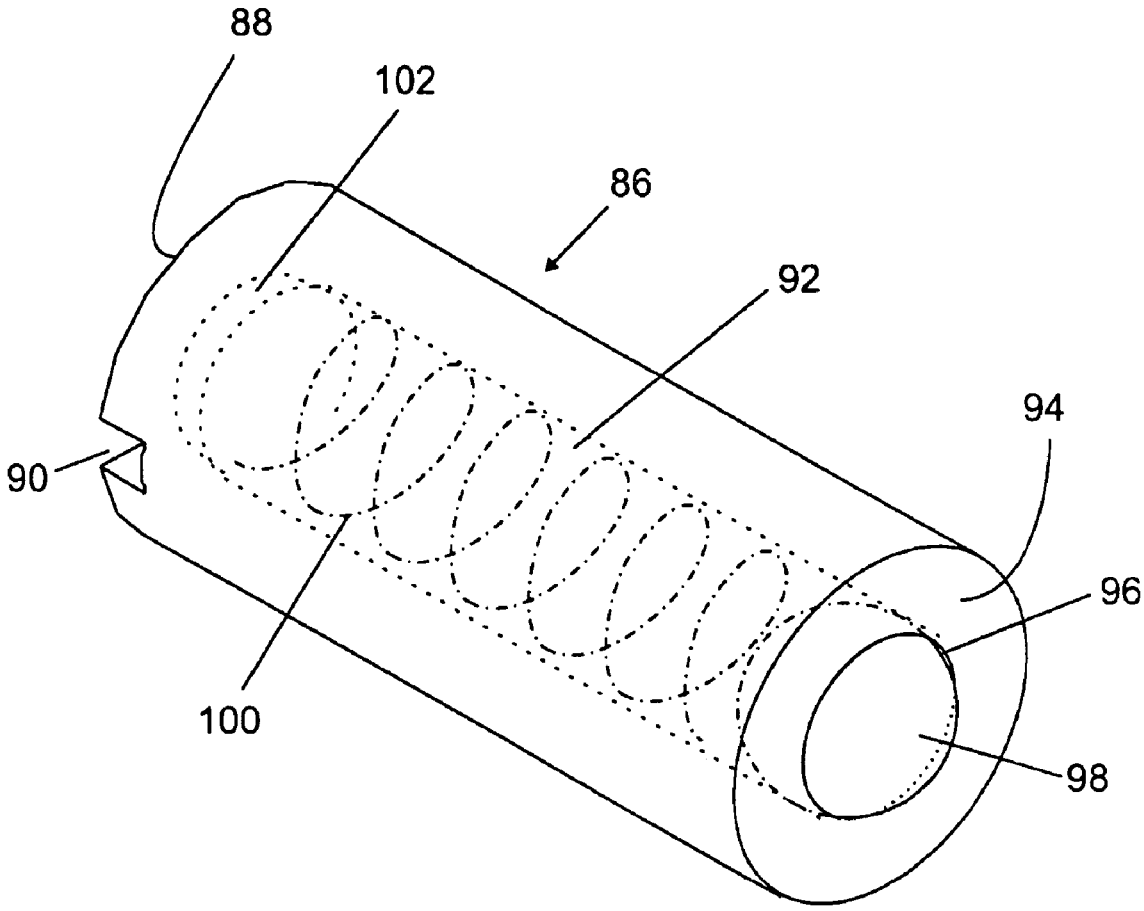
FIG. 7 shows a perspective view of a hollow pin for securing the applicator nozzle arrangement and the applicator head relative to each other.

As an alternative to the centering pin 62, a hollow pin 86 with a male screwthread is screwed into the through bore 60 (FIG. 7). The hollow pin has a slot 90 on its one end face 88. Extending from the end face 88 is a central axial blind bore 92. Disposed opposite the end face 88 is a second end face 94. The blind bore 92 extends along the longitudinal axis of the hollow pin 86, terminates shortly before the end face 94, and there goes into a second central bore 96 which extends axially from the end face 94. Arranged in the region in which the blind bore 92 goes into the bore 96 is a ball 98 whose diameter is between the diameter of the bore 96 and that of the blind bore 92. Acting against the ball 98 is a compression spring 100 which extends through the blind bore 92 and terminates at a closure portion 102 which terminates flush with the end face 88 and the slot 90 and is glued into the blind bore 92. The compression spring 100 braces the ball 98 against the closure portion 102 so that a fraction of the ball 98 projects beyond the end face 94. The ball is pressed into the blind bore 92 by pressing against the ball in opposition to the spring force.

The hollow pin 86 and the centering pin 62 are alternatives which both co-operate with the slot 80. The arresting pin 84 is a redundancy in relation to both so that only the arresting pin 84, the centering pin 62, or the hollow pin 86 is sufficient to guarantee that the applicator nozzle arrangement 14 is secured on the applicator head 10.

Figure 8:
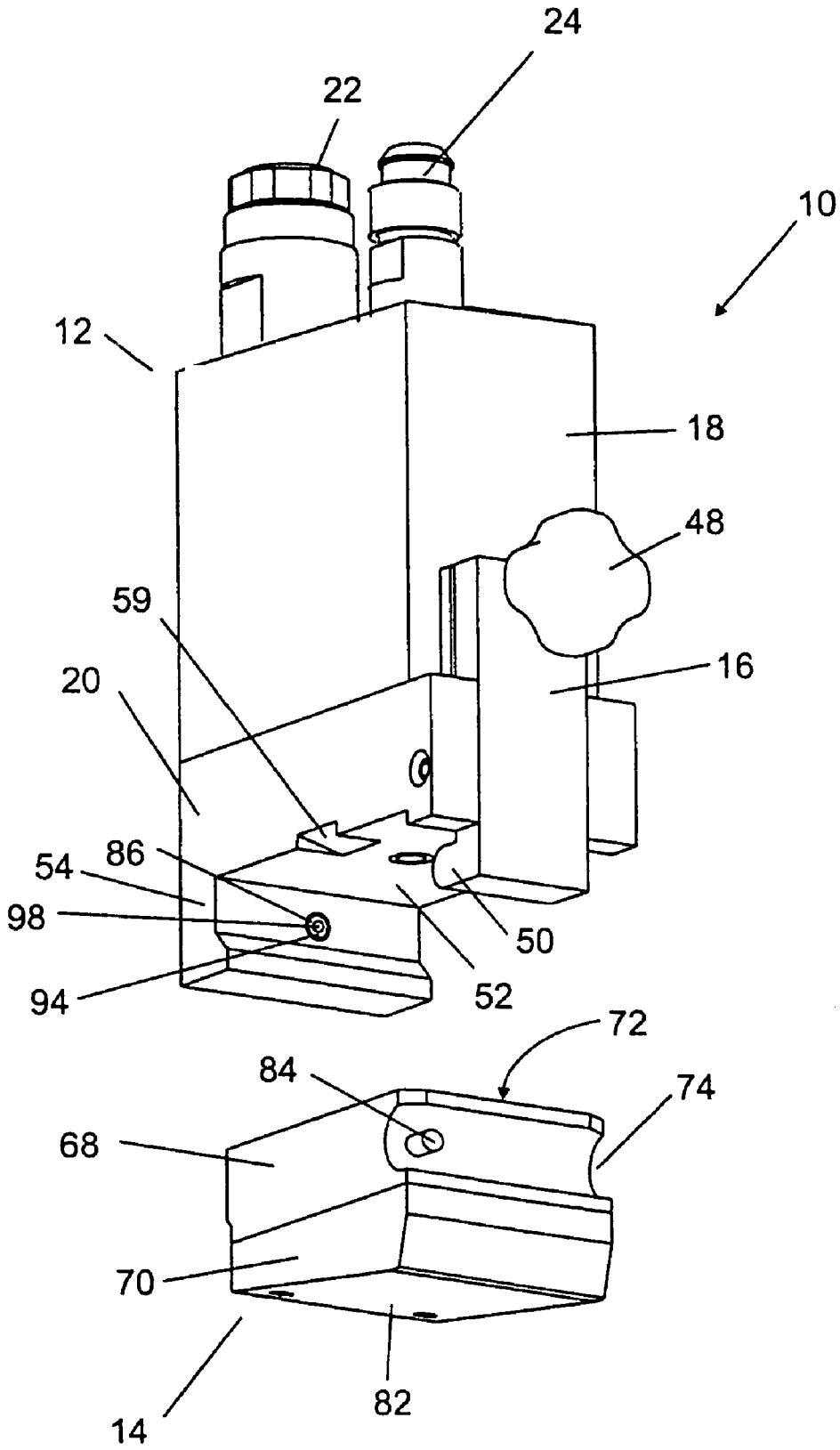
FIG. 8 shows a further perspective view of the components as shown in FIG. 3, with the hollow pin shown in FIG. 7.

FIG. 8 shows the position of the hollow pin 86 upon installation in the mounting plate 20. In that case the end face 94 terminates flush with the projection 54 so that only the ball 98 projects on the side proximate the lever 16. When the applicator nozzle arrangement 14 is pushed into the space formed by the projection 54 and the convex contour 50, the ball 98 is urged into the blind bore 92 (see FIG. 7) by the projection 76 (see FIG. 3). When the applicator nozzle arrangement 14 is in the correct position relative to the mounting plate 20, the ball 98 snaps into the slot 80 (see FIG. 3) by virtue of the force exerted by the compression spring 100 (see FIG. 7) and thus secures the applicator nozzle arrangement 14 relative to the mounting plate 20.

A torque is applied to the lever 16 by rotating the adjusting screw 48 through 180°-360° in the clockwise direction. As a result of that torque, the end of the lever 16 with the convex contour 50 moves further into the recess 74 and applies a force to the applicator nozzle arrangement 14, which extends substantially parallel to the contact surfaces 52 and 72. That force urges the applicator nozzle arrangement 14 in a direction towards the projection 54. In that situation the sliding surface 78 slides against the flat guide surface 56 of the projection 54, with the applicator nozzle arrangement 14 being moved further towards the main body 12. In that case the projection acts as a support for the lever 16 such that the applicator nozzle arrangement 14 and the main body are braced relative to each other. To this end, the bores 58 and 81 are directly one above the other and are sealed off relative to each other by the O-ring 83.

To release the connection between the applicator nozzle arrangement 14 and the main body 12 the adjusting screw 48 is rotated in the anti-clockwise direction. This reduces the force applied to the adaptor plate 68 by the lever 16. The applicator nozzle arrangement 14 is then removed from the main body 12 by a translatory movement.

Such a fixing mechanism means that different adaptor plates 68 which are adapted in respect of their design configurations to the respective situation of use can be easily and quickly fixed and released.

The invention claimed is:

1. An apparatus for applying fluid from a fluid source to a substrate, comprising:

a housing configured to receive the fluid from the fluid source, said housing including a nozzle contact surface, a fluid outlet in said nozzle contact surface, a projection extending downwardly from said nozzle contact surface, a guide surface on said projection and inclined relative to said nozzle contact surface to define an undercut surface on said projection, and first alignment structure on said projection between said guide surface and said nozzle contact surface, said first alignment structure extending away from said undercut surface and adapted to vertically support a nozzle on said housing;

a nozzle arrangement in fluid communication with said housing, said nozzle arrangement having an inlet side positioned adjacent said nozzle contact surface, an outlet side opposite said inlet side, a discharge passage communicating with said fluid outlet and extending from said inlet side to said outlet side, opposed first and second sidewalls between said inlet side and said outlet side, a surface proximate said outlet side and engaging said guide surface of said housing, and second alignment structure on said second sidewall, said second alignment structure cooperating with said first alignment structure on said projection to align said fluid outlet with said discharge passage; and a lever pivotally mounted to said housing for releasably securing said nozzle arrangement adjacent said nozzle contact surface, said lever having a lower end cooperating with said first sidewall such that said nozzle arrangement may be linearly guided in a direction transverse to the direction of fluid flow from the outlet between said lower end of said lever and said projection of said housing.

2. The apparatus of claim 1, wherein said lower end of said lever is configured to apply a force to said nozzle arrangement in a direction substantially parallel to a plane containing said inlet side and said nozzle contact surface.

3. The apparatus of claim 2, wherein said projection of said housing has a substantially flat guide surface adapted to direct said nozzle arrangement towards said housing when said lever applies force to said nozzle arrangement.

4. The apparatus of claim 1, wherein said lever has an upper end with a bore, the apparatus further comprising:

an adjusting screw extending through said bore in said lever, said adjusting screw having threads cooperating with said bore such that the rotation of said adjusting screw controls the pivotal movement of said lever.

5. The apparatus of claim 1, wherein said nozzle arrangement further includes a concave recess in said first sidewall and said lower end of said lever further includes a convex portion configured to be received in said concave recess.

6. The apparatus of claim 5, wherein said projection of said housing has a concave portion and said second sidewall of said nozzle arrangement further includes a projection configured to be received in said concave portion.

7. The apparatus of claim 6, further comprising:

a sealing element positioned between said nozzle arrangement and said housing.

8. The apparatus of claim 7, wherein said nozzle contact surface further includes a recess configured to prevent said sealing element from being sheared off when said nozzle arrangement is linearly guided between said projection of said housing and said lower end of said lever.

9. The apparatus of claim 1, wherein said first alignment structure on said projection of said housing includes a bore.

10. The apparatus of claim 9, wherein said first alignment structure further comprises in said bore.

11. The apparatus of claim 9, wherein said first alignment structure further comprises a ball and spring in said bore.

12. The apparatus of claim 1, wherein said housing comprises:

a dispenser configured to communicate with the fluid source; and a mounting plate secured to said dispenser and configured to cooperate with said lever so that said nozzle arrangement can be releasably secured thereto.

13. The apparatus of claim 1, wherein said nozzle arrangement comprises:

an adaptor plate configured to cooperate with said projection of said housing and said lower end of said lever to releasably secure said nozzle arrangement to said housing; and a nozzle plate releasably secured to said adaptor plate, said nozzle plate being configured to deliver the fluid to the substrate.

14. The apparatus of claim 1, wherein said first alignment structure projects outwardly from said undercut surface.

15. An apparatus for applying fluid from a fluid source to a substrate, comprising:

a housing configured to receive the fluid from the fluid source, said housing having a nozzle contact surface with a fluid outlet and a projection extending downwardly from said nozzle contact surface;

a nozzle arrangement in fluid communication with said housing, said nozzle arrangement having an inlet side positioned adjacent said nozzle contact surface, an outlet side opposite said inlet side, a discharge passage communicating with said fluid outlet and extending from said inlet side to said outlet side, opposed first and second sidewalls between said inlet side and said outlet side, and a concave recess provided in said first sidewall; and a lever pivotally mounted to said housing for releasably securing said nozzle arrangement adjacent said nozzle contact surface, said lever having a lower end configured to be received in said concave recess on said first sidewall.

16. The apparatus of claim 15, wherein said lower end of said lever is configured to apply a force to said nozzle arrangement in a direction substantially parallel to a plane containing said inlet side and said nozzle contact surface.

17. The apparatus of claim 16, wherein said projection of said housing has a substantially flat guide surface adapted to direct said nozzle arrangement towards said housing when said lever applies force to said nozzle arrangement.

18. The apparatus of claim 15, wherein said lever has an upper end with a bore, the apparatus further comprising:

an adjusting screw extending through said bore in said lever, said adjusting screw having threads cooperating with said bore such that the rotation of said adjusting screw controls the pivotal movement of said lever.

19. The apparatus of claim 15, wherein said projection of said housing has a concave portion and said second sidewall of said nozzle arrangement further includes a projection configured to be received in said concave portion.

20. The apparatus of claim 15, further comprising:

a sealing element positioned between said nozzle arrangement and said housing, said housing having a groove configured to accommodate said sealing element.

21. The apparatus of claim 15, wherein said projection of said housing includes a bore, the apparatus further comprising:

a pin positioned in said bore on said projection, said pin having a raised portion extending beyond said projection and configured to contact said nozzle arrangement.

22. The apparatus of claim 21, wherein said pin is configured to threadly engage said bore on said projection of said housing.

23. The apparatus of claim 21, wherein said pin is hollow and further includes a ball and spring positioned therein.

24. The apparatus of claim 15, wherein said housing comprises:

a dispenser configured to communicate with the fluid source; and a mounting plate secured to said dispenser and configured to cooperate with said lever so that nozzle arrangement can be releasably secured thereto.

25. The apparatus of claim 15, wherein said nozzle arrangement comprises:

an adaptor plate configured to cooperate with said projection of said housing and said lower end of said lever to releasably secure said nozzle arrangement to said housing; and a nozzle plate releasably secured to said adaptor plate, said nozzle plate being configured to deliver the fluid to the substrate.

26. An apparatus for applying fluid from a fluid source to a substrate, comprising:

a housing configured to receive the fluid from the fluid source, said housing including a nozzle contact surface, a fluid outlet in said nozzle contact surface, a projection extending downwardly from said nozzle contact surface, and a bore in said projection;

a nozzle arrangement in fluid communication with said housing, said nozzle arrangement having an inlet side positioned adjacent said nozzle contact surface, an outlet side opposite said inlet side, a discharge passage communicating with said fluid outlet and extending from said inlet side to said outlet side, and opposed first and second sidewalls between said inlet side and said outlet side;

a pin in said bore of said housing, said pin including a raised portion extending beyond said projection and configured to contact said nozzle arrangement; and a lever pivotally mounted to said housing for releasably securing said nozzle arrangement adjacent said nozzle contact surface, said lever having a lower end cooperating with said first sidewall such that said nozzle arrangement may be linearly guided in a direction transverse to the direction of fluid flow from the outlet between said lower end of said lever and said projection of said housing.

* * * * *

UNITED STATES PATENT AND TRADEMARK OFFICE

CERTIFICATE OF CORRECTION

PATENT NO. : 7,399,361 B2
APPLICATION NO. : 11/115059
DATED : July 15, 2008
INVENTOR(S) : Victor de Leeuw et al.

It is certified that error appears in the above-identified patent and that said Letters Patent is hereby corrected as shown below:

Column 8

Line 45, after "comprises" insert --a pin--.

Column 10

Line 2, change "threadly" to --threadably--.

Line 11, after "that" insert --said--.

Signed and Sealed this

Fifth Day of May, 2009

JOHN DOLL
*Acting Director of the United States Patent and Trademark Office*